US012114735B2

(12) United States Patent
Goff

(10) Patent No.: US 12,114,735 B2
(45) Date of Patent: Oct. 15, 2024

(54) MULTIPLE CLEAT PLATE SOLE

(71) Applicant: Jeffery Stuart Goff, Indian Land, SC (US)

(72) Inventor: Jeffery Stuart Goff, Indian Land, SC (US)

( * ) Notice: Subject to any disclaimer, the term of this patent is extended or adjusted under 35 U.S.C. 154(b) by 77 days.

(21) Appl. No.: 18/067,313

(22) Filed: Dec. 16, 2022

(65) Prior Publication Data

US 2023/0189937 A1 Jun. 22, 2023

Related U.S. Application Data

(60) Provisional application No. 63/265,538, filed on Dec. 16, 2021.

(51) Int. Cl.
*A43C 15/00* (2006.01)
*A43B 5/02* (2006.01)
*A43C 15/16* (2006.01)

(52) U.S. Cl.
CPC ..... *A43C 15/162* (2013.01); *A43B 5/02* (2013.01); *A43C 15/00* (2013.01)

(58) Field of Classification Search
CPC ..... A43C 15/00; A43C 15/161; A43C 15/162; A43B 5/02
USPC ..... 36/134
See application file for complete search history.

(56) References Cited

U.S. PATENT DOCUMENTS 1,391,346 A 9/1921 Schwarzer
2,070,269 A * 2/1937 Goldenberg ..... A43C 13/04 36/108
2,203,929 A * 6/1940 Shapiro ..... A43C 15/161 36/134
3,204,347 A * 9/1965 Snow ..... B29C 70/682 36/134
3,333,352 A * 8/1967 John ..... A43B 5/02 36/107
3,337,971 A * 8/1967 Rose ..... A43B 5/001 36/134
3,492,744 A * 2/1970 Bernier ..... A43C 15/167 264/44
3,512,274 A * 5/1970 McGrath ..... A43B 5/001 36/134
3,577,503 A * 5/1971 Innocenti ..... B29D 35/061 425/119
3,735,507 A * 5/1973 Granger ..... A43B 5/001 36/67 D
3,738,026 A * 6/1973 Granger ..... A43B 5/001 36/134
3,739,497 A * 6/1973 Cameron ..... A43B 5/00 36/114
3,744,160 A * 7/1973 Dymond ..... A43B 5/00 36/114

(Continued)

*Primary Examiner* — Marie D Bays
(74) *Attorney, Agent, or Firm* — Dunlap Bennett & Ludwig, PLLC; Anna L. Kinney

(57) ABSTRACT

An article of footwear with a cleated sole includes an upper with an affixed midsole and multiple cleat plates spaced from one another; and an outsole encircling at least one of the cleat plates, affixed to the midsole. The cleat plates include a flat base with at least one cleat extending perpendicular to the surface. The bases are more pliant than the cleats and the outsole is more pliant than the bases. The footwear is comfortable and allows the foot to be the primary acting force in the beginning of locomotion, contributing to the athlete's strength and health.

9 Claims, 4 Drawing Sheets

(56) References Cited

U.S. PATENT DOCUMENTS

| | | | | |
|---|---|---|---|---|
| 4,043,058 | A | 8/1977 | Hollister et al. | |
| 4,454,664 | A * | 6/1984 | MacNeil | A43B 5/001 36/114 |
| 4,698,923 | A | 10/1987 | Arff | |
| 4,748,752 | A | 6/1988 | Tanel | |
| 5,058,292 | A | 10/1991 | Tanel | |
| 5,367,791 | A | 11/1994 | Gross et al. | |
| 5,384,973 | A | 1/1995 | Lyden | |
| 5,775,005 | A * | 7/1998 | McClelland | A43B 13/184 36/31 |
| 5,829,172 | A | 11/1998 | Kaneko | |
| 6,082,024 | A | 7/2000 | Del Biondi | |
| 6,935,055 | B2 | 8/2005 | Oorei | |
| 7,200,955 | B2 | 4/2007 | Foxen | |
| 7,370,439 | B1 * | 5/2008 | Myers | A43B 13/26 36/31 |
| 8,215,035 | B2 | 7/2012 | Mills et al. | |
| 8,567,098 | B2 | 10/2013 | Hsu | |
| 8,584,380 | B2 | 11/2013 | Auger et al. | |
| 8,863,410 | B2 | 10/2014 | Schmid | |
| 9,526,297 | B2 | 12/2016 | Davis | |
| 10,058,147 | B2 | 8/2018 | Wernow et al. | |
| 10,104,938 | B2 | 10/2018 | Auger et al. | |
| 10,182,611 | B2 | 1/2019 | Auger et al. | |
| 10,786,038 | B2 | 9/2020 | Berend et al. | |
| 10,842,223 | B2 | 11/2020 | Amis et al. | |
| 10,932,527 | B2 | 3/2021 | Hatfield et al. | |
| 10,993,500 | B2 | 5/2021 | Wardle | |
| 2008/0098624 | A1 | 5/2008 | Goldman | |
| 2008/0196274 | A1 * | 8/2008 | Gerber | A43B 13/36 36/100 |
| 2014/0082969 | A1 * | 3/2014 | Binzer | A43C 15/161 36/107 |
| 2016/0278484 | A1 * | 9/2016 | Aslani | A43B 5/02 |
| 2019/0014866 | A1 | 1/2019 | Schiller et al. | |
| 2021/0015205 | A1 * | 1/2021 | Farr | B29D 35/142 |
| 2021/0085021 | A1 | 3/2021 | Bardini | |
| 2021/0093039 | A1 | 4/2021 | Paterson et al. | |
| 2021/0259357 | A1 | 8/2021 | Paterson et al. | |
| 2023/0346075 | A1 * | 11/2023 | Thompsett | A43B 13/16 |

* cited by examiner

MULTIPLE CLEAT PLATE SOLE

CROSS-REFERENCE TO RELATED APPLICATION

This application claims the benefit of priority of U.S. provisional application No. 63/265,538, filed Dec. 16, 2021, the contents of which are herein incorporated by reference.

BACKGROUND OF THE INVENTION

The present invention relates to cleated athletic shoes and, more particularly, to a multiple cleat plate sole.

Existing cleats lack flexibility and movement and thus do not allow for strength to develop in the foot of developing athletes. Solid or two-part cleat plate soled shoes restrict the movement of the foot. This is due to a faulty assumption that the foot must be immobilized, and that the optimal function of a shoe is to make the foot do as little work as possible while remaining comfortable.

As can be seen, there is a need for cleats that allow flexibility and movement of the foot.

SUMMARY OF THE INVENTION

In one aspect of the present invention, an article of footwear with a cleated sole, comprises an upper having a midsole affixed thereto; a plurality of cleat plates, each comprising a substantially planar base with at least one cleat extending normal thereto, affixed to the midsole in locations spaced from one another; and a outsole encircling at least one of the plurality of cleat plates, the outsole affixed to the midsole. The substantially planar base is more pliant than the at least one cleat and the outsole is more pliant than the substantially planar base.

The flexible cleat plate arrangement of the present subject matter is comfortable and enables the foot to be the primary acting force in the beginning of locomotion, contributing to the athlete's strength and health. The cleat plate may be used by any athlete that wants to maintain their natural foot function and strength while engaging in activities requiring enhanced traction on loose grassy surfaces. The flexible cleat plate arrangement may also be used by non-athletes to enhance traction on loose grassy and dirt surfaces for hiking or general ambulation.

These and other features, aspects and advantages of the present invention will become better understood with reference to the following drawings, description, and claims.

DETAILED DESCRIPTION OF THE INVENTION

Figure 1:
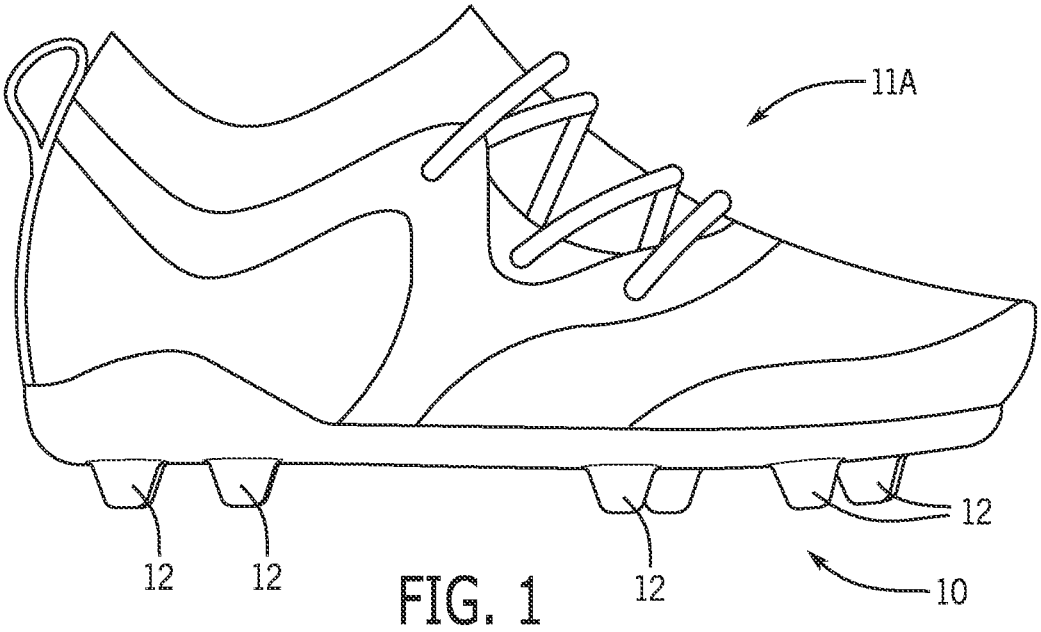
FIG. 1 is a side elevation view of a cleated shoe sole according to an embodiment of the present invention.

The following detailed description is of the best currently contemplated modes of carrying out exemplary embodiments of the invention. The description is not to be taken in a limiting sense but is made merely for the purpose of illustrating the general principles of the invention, since the scope of the invention is best defined by the appended claims.

The terms "cleat" and "stud" may be used interchangeably herein.

As used herein, the term "pliant" refers to a material that is flexible, i.e., malleable and resilient.

The term "normal" is used herein in the sense of "perpendicular to" a surface.

Broadly, one embodiment of the present invention is an article of footwear with a cleated sole comprising multiple, independent cleat plates.

The sole may comprise four or more independently moving plates enabling independent movement of the big toe, the 2nd through 5th toes, the midfoot, and the heel. The plates are spaced within the sole in a manner analogous to islands in a body of rubber or other elastic polymer. The flexible cleat plate arrangement distributes pressure and does not compromise motion of the foot's 33 joints. The plates act as independent bases of support with the rubber or thermoplastic polyurethane sole acting as the flexible joint medium. The stud plates may be affixed to a shoe midsole and bordered by a flexible or rigid rounded base. The cleat plates stay secure in the rubber or thermoplastic polyurethane sole as the sole flexes to accommodate the forces exerted by the foot through the full range of motion.

The dimensions of the sole's components are not particularly limited. The sole thickness may affect the flexibility of the shoe and may have any suitable thickness, such as about 0.5 mm, 1 mm, 2 mm, 3 mm, 4 mm, 5 mm, about 6 mm, and any thickness therebetween. The cleat plate material may have a thickness about the same as the thickness of the sole and may have components with smaller or larger thicknesses. The cleats may have a height from the base greater than the thickness of the base. The depth may be about 2, about 3, about 4, or more, times greater than the base thickness, and any depth therebetween.

The sole may have any suitable flexibility determined by a variety of measures. For example, a suitable material may have about 68 degrees shore A hardness or less, a Yield strength of about 1 MPa or more, such as about 3 MPa, about 10 MPa, even about 50 MPa or more, and any strength in between, and/or an elongation at break of about 200% or more.

The shape of the cleats is not particularly limited. For example, they may have a cross-sectional shape, parallel to the sole, selected from the group consisting of circular, triangular, polygonal, and any combination thereof. The sole may have some frustoconical cleats, some cleats having a frustotriangular prismatic shape, and some frustopyramidal cleats, for example. The edges and/or corners of the cleats may be rounded. The exterior surface of the cleats may have an indented or protruding pattern.

The cleat plate configured for use on the heel may have a radiused edge that wraps around the heel of the midsole.

The type of cleat is not particularly limited and may include turf cleats and field cleats. The number of cleats on each plate is not particularly limited. For example, a plate may have a single cleat up to about 6, 7, 8, 9, 10, 11, or 12 cleats. In some cases, more cleats are envisioned.

The materials of manufacture are not particularly limited and may include rubber, hard plastic, and combinations thereof. For example, the stud plates and/or the studs may be manufactured from a natural and/or a synthetic rubber, a thermoplastic elastomer such as a block copolymer comprising rigid polyamide blocks and soft polyether blocks, and combinations thereof. The base surrounding the cleat plates may be manufactured of natural rubber, synthetic rubber, or thermoplastic polyurethane. In some embodiments, the base and the cleats may be manufactured as a unitary rubber or thermoplastic polyurethane component.

The method of manufacture is not particularly limited. Four three-dimensional (3D) printed or injection molded plastic plates may be made, one for the big toe, one for toes 2 through 5, one for the ball of the foot area, and one for the heel. The four cleat plates may be joined, e.g., with epoxy, glue, or a heating process, to any athletic shoe upper.

In some embodiments, the four cleat plates may be set into a molded rubber sole, with sections cut out for the cleat plates. The plates and the rubber sole may be bonded together with epoxy, glue, or a heating process and the finished sole may be joined to any athletic shoe upper.

Figure 2:
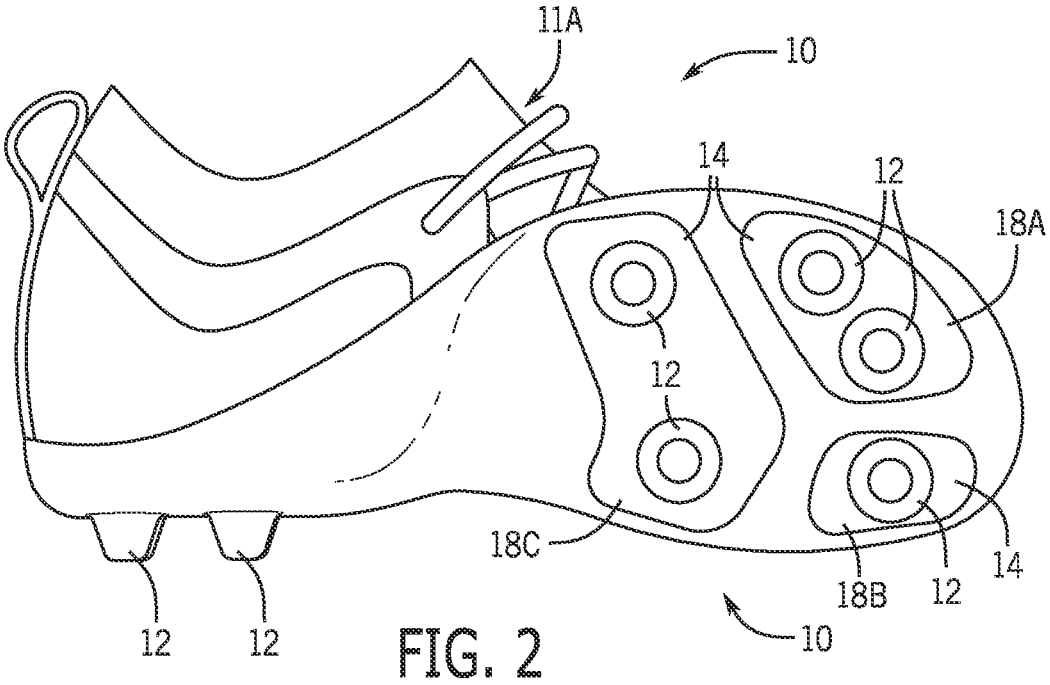
FIG. 2 is a partial side elevation view thereof, with the shoe sole in a twisted position.
Figure 3:
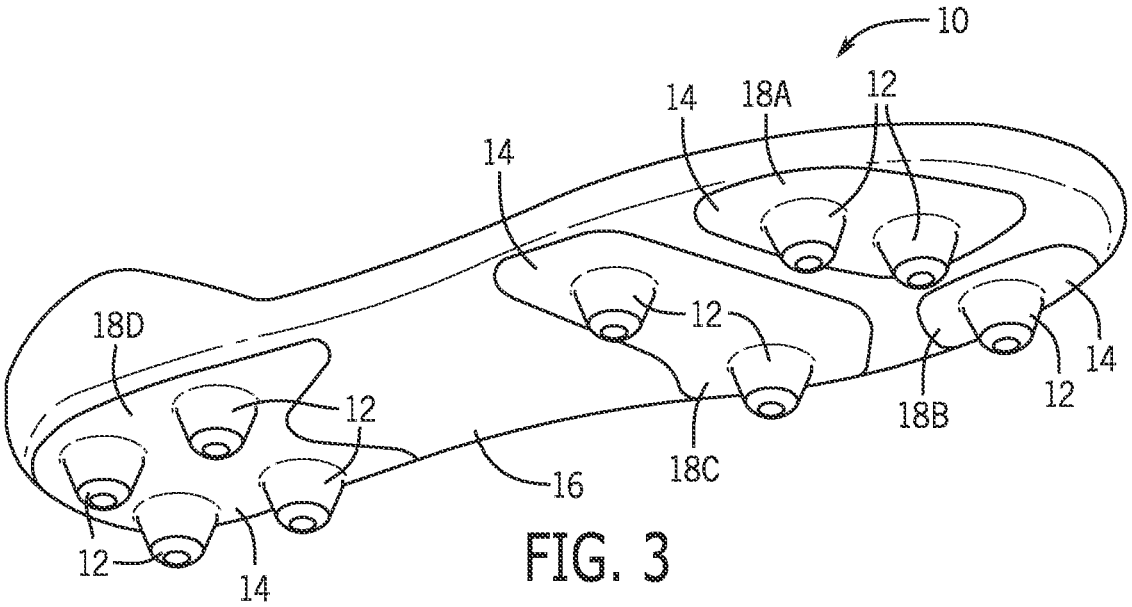
FIG. 3 is a bottom perspective view thereof.
Figure 4:
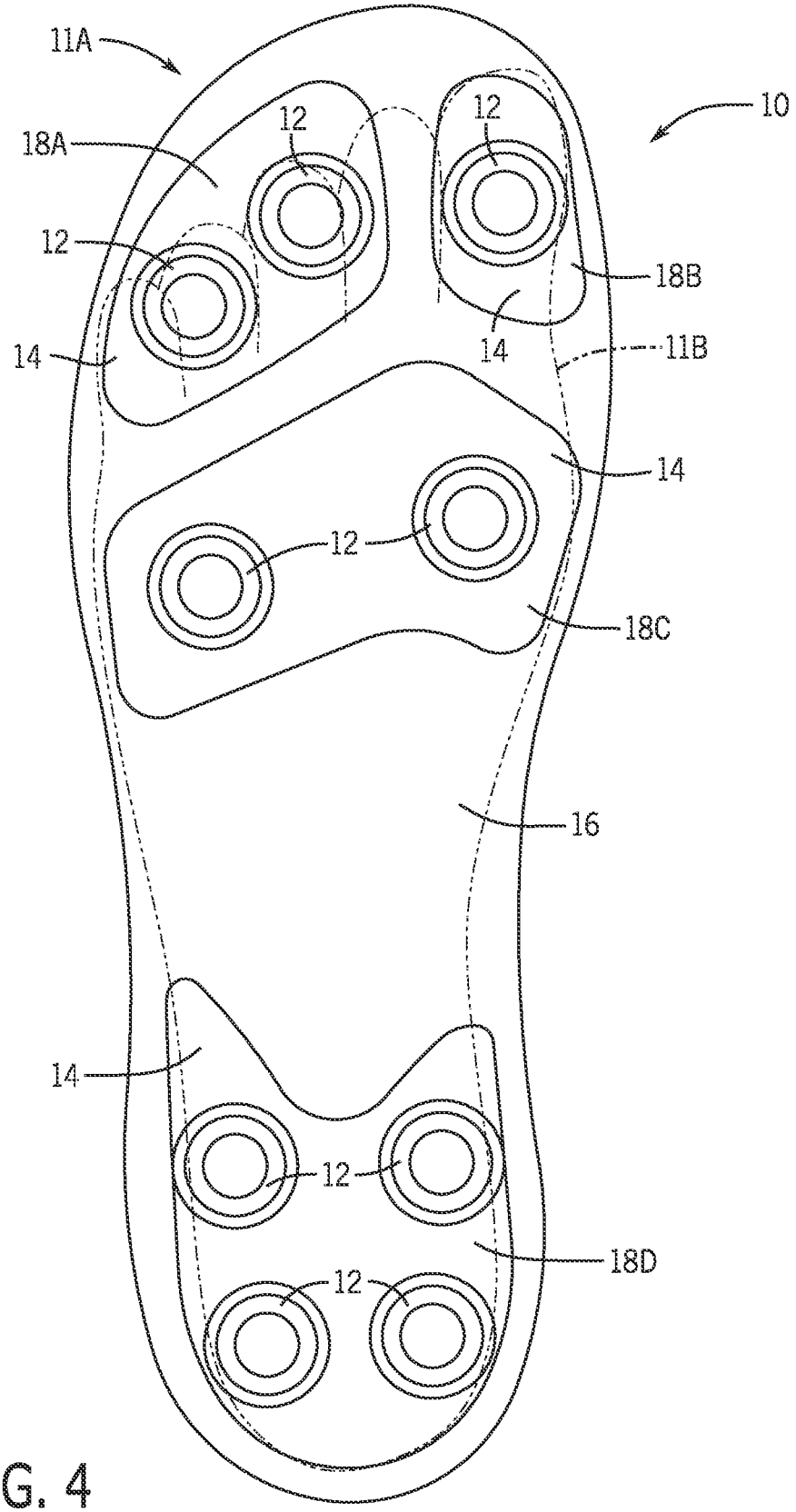
FIG. 4 is a bottom plan view thereof.

Referring to FIGS. 1 through 5, FIG. 1 illustrates a field cleated shoe 11A according to an embodiment of the present invention with a cleated sole 10 made up of independent cleat plates 18A, 18B, 18C, 18D affixed to the shoe 11A within a flexible thermoplastic outsole 16. The cleat plates 18A, 18B, 18C, 18D each have at least one cleat 12 extending from a thermoplastic base 14, as more clearly seen in FIGS. 3 and 4, which may have a pliancy between that of the outsole 16 and the cleat 12. In some cases, the bases 14 are rigid. As shown in FIGS. 2 and 4, the big toe, or hallux, of the user's foot 11B rests on a first cleat plate 18B; the toes 2-5 rest on a second cleat plate 18A; the ball of the foot rests on a third cleat plate 18C, and the heel rests on a fourth cleat plate 18D. The arch of the foot does not have a cleat plate; the location is excluded to provide for flexibility.

Figure 5:
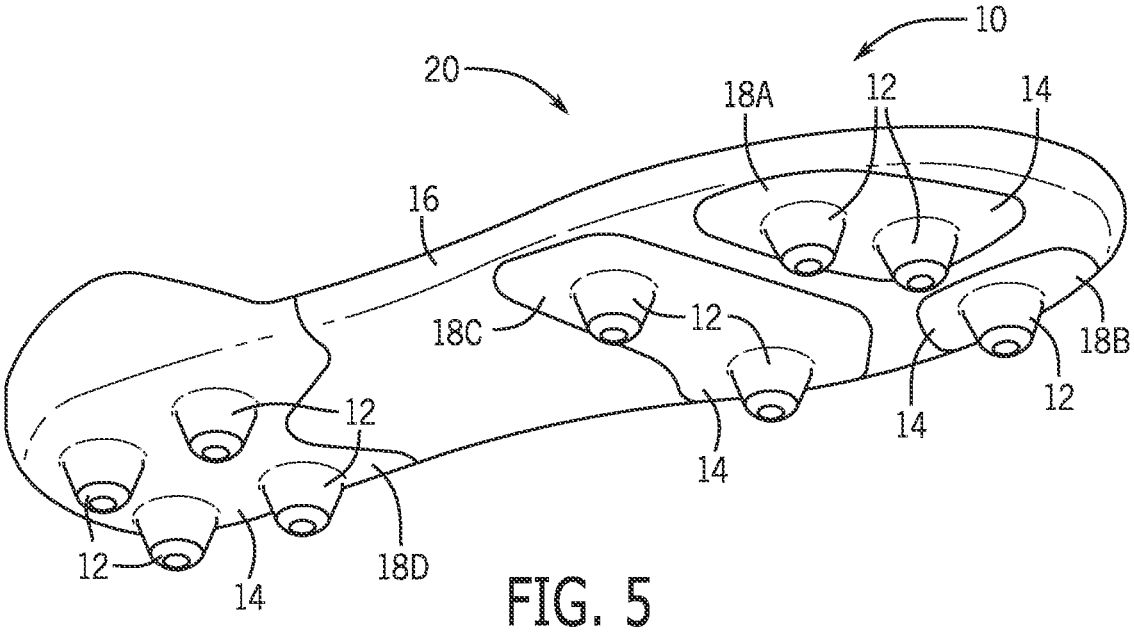
FIG. 5 is a bottom perspective view of a cleated shoe sole according to another embodiment of the present invention.

FIG. 5 illustrates a cleated sole 20 according to a second embodiment, with a heel cleat plate 18D affixed to the midsole abutting the base of the outsole 16, the base 14 of the cleat plate 18D rising to wrap around the heel midway up the heel counter.

It should be understood, of course, that the foregoing relates to exemplary embodiments of the invention and that modifications may be made without departing from the spirit and scope of the invention as set forth in the following claims.

What is claimed is:

1. An article of footwear with a cleated sole, comprising:

an upper having a midsole affixed thereto;

a plurality of cleat plates, each comprising a substantially planar base with at least one cleat extending normal thereto, affixed to the midsole in locations spaced from one another including a first cleat plate at a hallux; a second cleat plate at a third, fourth, and fifth toe; a third cleat plate at a ball of a foot; and a fourth cleat plate at a heel; and a outsole encircling at least one of the plurality of cleat plates, the outsole affixed to the midsole;

wherein the substantially planar base is more pliant than the at least one cleat and the outsole is more pliant than the substantially planar base.

2. The article of footwear of claim 1, wherein the at least one cleat has a rounded shape selected from the group consisting of frustoconical, frustopyramidal, and frustotriangular prismatic.

3. The article of footwear of claim 1, wherein the locations exclude an arch of a foot.

4. The article of footwear of claim 1, wherein the outsole and the plurality of cleat plates are formed as a unitary component.

5. The article of footwear of claim 1, wherein the first cleat plate has one to three cleats.

6. The article of footwear of claim 1, wherein the second cleat plate has about 2 to about 6 cleats.

7. The article of footwear of claim 1, wherein the third cleat plate has about 2 to about 9 cleats.

8. The article of footwear of claim 1, wherein the fourth cleat plate has a radiused edge that wraps around the heel of the midsole.

9. The article of footwear of claim 1, wherein the fourth cleat plate has about 4 to about 11 cleats.

* * * * *